United States Patent [19]

Mitsuda et al.

[11] Patent Number: 4,603,994

[45] Date of Patent: Aug. 5, 1986

[54] BALL-HOLDER OF A BALL-POINT PEN

[75] Inventors: Yoshinobu Mitsuda; Tai Inami; Koji Mori, all of Soka, Japan

[73] Assignee: Pentel Kabushiki Kaisha, Tokyo, Japan

[21] Appl. No.: 373,260

[22] Filed: Apr. 29, 1982

[30] Foreign Application Priority Data

Apr. 30, 1981 [JP] Japan ..... 56-62732[U]

[51] Int. Cl.[4] ..... B43K 7/00; B43K 7/10

[52] U.S. Cl. ..... 401/209; 401/199; 401/216

[58] Field of Search ..... 401/199, 209, 212, 216

[56] References Cited

U.S. PATENT DOCUMENTS

| | | | |
|---|---|---|---|
| 3,003,182 | 10/1961 | Rosenthal | 401/199 X |
| 3,048,879 | 8/1962 | Rosenthal | 401/199 |
| 3,050,768 | 8/1962 | Rosenthal | 401/199 |
| 3,729,269 | 4/1973 | Koeln | 401/209 |
| 3,904,297 | 9/1975 | Hori | 401/216 |
| 4,139,313 | 2/1979 | Hori | 401/216 |

FOREIGN PATENT DOCUMENTS

| | | | |
|---|---|---|---|
| 2635546 | 8/1975 | Fed. Rep. of Germany | 401/209 |

OTHER PUBLICATIONS

Japanese Utility Model Laid-Open Publication No. 55-148984, laid-open date: Oct. 27, 1980; Appln. No. 54-49644; inventor: T. Yokoshuka.

*Primary Examiner*—Steven A. Bratlie

*Attorney, Agent, or Firm*—Robert E. Burns; Emmanuel J. Lobato; Bruce L. Adams

[57] ABSTRACT

A ball-holder of a ball-point pen comprises a writing ball rotatably held at one end of a metal tube, and a synthetic resin rod inserted into the tube with one end of the rod defining a ball seat in rotatable contact with the ball. The rod is secured to the tube proximate the ball seat by press deforming the tube from two opposite directions to form two inward projections of the tube which project inwardly into engagement with the rod to fixedly secure the rod to the tube. During the press deforming of the tube to form the two projections, the two portions of the tube situated between the two projections are expanded outwardly to form a pair of expansions of the metal tube which are effective to prevent disruption of the ink flow which would otherwise occur due to the two projections.

10 Claims, 3 Drawing Figures

BALL-HOLDER OF A BALL-POINT PEN

FIELD AND BACKGROUND OF THE INVENTION

This invention relates to a ball-holder of a ball-point pen, in which a writing ball is rotatably supported in a metallic tube and a rod is inserted in the tube to guide the ink, and more particularly to a ball-holder in which the ink guide rod is fixed in the tube without preventing the ink from flowing smoothly in the ball-holder.

In the case of a ball-point pen, a ball-holder having a writing ball and an ink guide rod of plastics for supplying the ink from an ink reservoir to the ball, is known, for example, as disclosed in U.S. Pat. No. 3,904,297. The writing ball is held in a reduced diameter portion of the metallic tube located at one end of the tube and formed by press-deforming of the tube so that a part of the ball projects from the reduced diameter portion. The rod is loosely inserted into the tube in such a manner that one end face of the same is used as a ball seat. The ink is delivered to the ball through a gap or clearance between the outer circumference of the rod and the inner circumference of the tube from an ink reservoir. Therefore the rod needs to be fixed fast in the tube so that the ball is not pushed back by the writing pressure.

For the purpose of fixing the rod in the tube, there has been employed a method in which the other end of the tube is formed with a constriction, or the other end of the rod is dimensioned to abut against a part of the body of the ball-pint pen itself. However, when the thin rod is fixed in the tube by being fixed at the portion opposite the ball seat-forming end, the state in which the ball and the ball seat-forming end contact with each other changes, because the coefficients of linear expansion of the metallic tube and the synthetic resin-made rod are different from each other. As a result, the writing efficiency may be lowered.

In order to overcome this disadvantage, and as described in Japanese utility model Application Laid Open No. 55-148984, there has been proposed a ball-holder in which the rod is held in the tube by being fixed at a portion close to the ball seat-forming end of the rod. This ball-holder is advantageous in that, because of the fixing point being close to the ball seat-forming end, the contacting state between the ball and the ball seat-forming end will change slightly even though the coefficients of linear expansion of the metallic tube and the rod are different from each other. To fix the rod in the metallic tube in this construction, three or more suitably spaced projections projecting toward the axis of the tube are made circumferentially of the tube thereby press-deforming the tube. If the metallic tube and the rod are fixed strongly enough, in this way, the ink channel between the tube and the rod is disrupted by the projections and the flow of the ink may be disturbed.

SUMMARY OF THE INVENTION

The object of the present invention is to provide a ball-holder for a ball-point pen which fixes the rod to the inside of the tube without preventing the ink from flowing smoothly in the ball-holder.

According to this invention, there is provided a ball-holder of a ball-point pen, comprised of a metallic tube having a reduced diameter portion at one end thereof, a writing ball set in the inner wall and a synthetic resin rod which is inserted into the metallic tube so as to form a ball seat at one end of the rod, the metallic tube being pressed and transformed on two sides of the rod close to the ball seat so as to form two inward projections which hold the rod and two expansions formed on the opposite sides.

In the ball-holder of a ball-point pen according to the present invention, the metallic tube has inward projections and expanded portions which are both formed by press-deforming of the metallic tube from two opposite directions. The inward projections hold the rod therebetween and the expanded portions are used as channels for ink. As a result, even when the thin rod is strongly fixed in the tube by the inward projections, the smooth flow of ink is not hindered because the ink channels can be made in a sufficiently large size.

DESCRIPTION OF THE PREFERRED EMBODIMENTS

Figure 1:
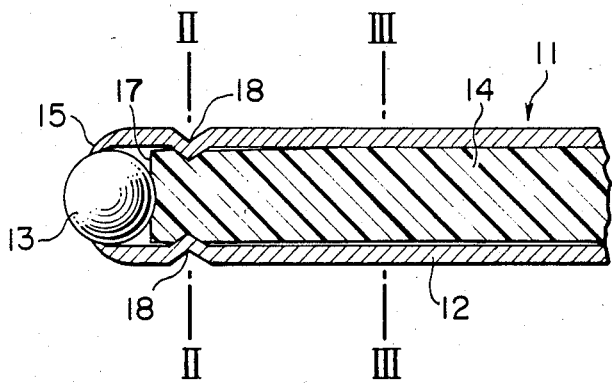
FIG. 1 is a longitudinal cross-sectional view showing an embodiment of the ball-holder of a ball-point pen according to the present invention.

A ball-holder is shown by the reference numeral 11. The ball-holder comprises a tube 12 which is made of metal such as stainless steel, nickel silver and the like, a metallic writing ball 13 which is rotatably held inside tube 12, and a rod 14 inserted into the tube 12 and being in contact at one end thereof with the ball 13 to define a ball seat. At the tip of the tube 12, there is formed a reduced diameter portion 15 having a diameter which is smaller than that of the ball 13. The ball 13 is held in an end portion 15 of the tube 12 in such manner that a part of the ball 13 projects from the tip of the tube 12. The rod 14 is made of plastics, such as polyacetal resin, polyamide resin and the like. On the periphery of the rod 14, there are formed a plurality of ink channels 16 which extend longitudinally of the rod. By these ink channels 16, the rod 14 may be press-fitted into the tube 12 without preventing the smooth flow of ink to the ball 13. However such channels need not be made on the rod 14. A pillar having a polygonal cross section, or a pillar or cylinder having an irregular outer periphery may alternatively be used. Furthermore, a cylindrical pillar having an outer diameter which is a little smaller than that of the tube 12 would be possible, too. In this case the gap between the inner periphery of the tube 12 and the outer periphery of the cylindrical pillar defines the channel for the ink. The rod 14 is fixed in the tube 12 so as to define a seat for the ball at one end 17 of the rod.

Figure 2:
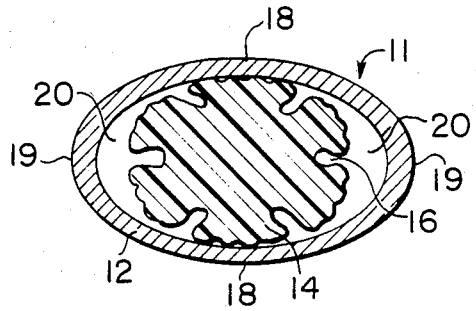
FIG. 2 is a cross-sectional view taken along the line II—II of FIG. 1.
Figure 3:
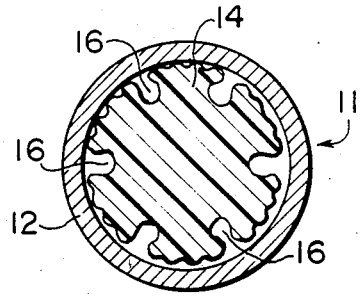
FIG. 3 is a cross-sectional enlarged view taken along the line III—III of FIG. 1.

The rod 14 is fixedly held between two inward projections 18 which are formed by external press-deforming of the tube 12 from two opposite directions. The inward projections 18 are situated close to the end face 17 of the rod 14. Preferably, the inward projections 18 are located closer to the end face 17 than as shown in FIG. 1 though the inward projections 18 may be located a few millimeters away from the end face 17 depending upon the diameter of the ball 13, the material for the rod 14, the ease of press-deforming the tube 12, and the like. The press-deforming of the tube 12 from two opposite directions to form the inward projections 18 also causes, as shown in FIG. 2, outwardly expanded portions 19 to be formed in the directions perpendicular to the imaginary line connecting the inward projections 18. These expanded portions or expansions 19 function as ink channels 20. In this embodiment, the total cross-sectional outline of the tube 12 at the portion where the press-deforming of the tube 12 takes place is almost an ellipse. This enables the ink channels 20 to be formed most effectively, and enables the rod 14 to be arranged in the center of the tube 12. The cross-sectional form of the tube 12 at the portion where the press-deforming takes place, however, is not restricted to an ellipse. For example, the shape could alternatively be a rectangle or a polygon.

As above mentioned, the present invention provides a ball-holder 11 of a ball-point pen in which the rod 14 is strongly fixed in the tube 12 by the inward projections 18 which are formed by press-deforming of the tube 12 from two opposite directions, and in which the supply of ink to the ball 13 is ensured by the ink channels 20 of the expanded portions 19 which are formed coincidently with the formation of the inward projections 18. The ball-holder of the present invention is applicable to ball-point pens in which the ink reservoir is fixedly provided, and to ball-point pens of the ink-cartridge type.

In addition, in the above embodiment each of the inward projections is formed to extend circumferentially of the metallic tube, but it is also possible that each inward projection is formed to extend lengthwise along the metallic tube.

We claim:

1. A ball-holder of a ball-point pen, comprising: a metallic tube having a reduced diameter portion at one end thereof, a writing ball rotatably held in the reduced diameter portion, and a synthetic resin rod inserted into the said metallic tube so as to form a ball seat at one end thereof, said metallic tube having two inward projections which hold the rod therebetween and two expanded portions expanded in opposite directions to each other along an imaginary line perpendicular to an imaginary line connecting the two inward projections, the inward projections and the expanded portions being positioned close to the ball seat and being formed by press-deforming of the metallic tube from two opposite directions.

2. A ball-holder according to claim 1, wherein the cross-sectional shape of the metallic tube at the portion where the press-deforming of the tube takes place approximates an ellipse.

3. A ball-holder according to claim 1, wherein the said inward projections extend circumferentially of the said metallic tube.

4. A ball-holder according to claim 1, wherein a plurality of channels for flowing ink are formed on the periphery of the rod and extend longitudinally thereof.

5. A ball-holder of a ball-point pen of the type in which ink flows from an ink reservoir through the ball-holder to the writing tip, comprising: a metal tube having means at one end thereof for rotatably holding a ball; a writing ball rotatably held at the one end of the metal tube and protruding partly therefrom to define a writing tip; a synthetic resin rod inserted into the metal tube and having means at one end thereof defining a ball seat in rotatable contact with the writing ball; means defining ink passages between the metal tube and the resin rod and extending lengthwise of the resin rod for flowing ink from an ink reservoir to the writing tip during use of the ball-holder; and means located proximate the ball seat for fixedly securing the resin rod in the metal tube so that the writing ball is held in rotatable contact with the ball seat while preventing the disruption of ink flow along the ink passages due to securing the resin rod in the metal tube, said means for fixedly securing the resin rod comprising a pair of diametrically opposed press-deformed projections of the metal tube which project inwardly into and engage diametrically opposite parts of the resin rod to fixedly secure the resin rod to the metal tube, and a pair of diametrically opposed press-deformed expansions of the metal tube which are expanded outwardly away from the resin rod at the same cross-sectional region of the metal tube at which the projections are located to effectively prevent disruption of the ink flow along the ink passages which would otherwise occur due to the projections.

6. A ball-holder according to claim 5; wherein the said cross-sectional region of the metal tube is oblong in shape.

7. A ball-holder according to claim 5; wherein the said cross-sectional region of the metal tube is generally elliptical in shape.

8. A ball-holder according to claim 5; wherein the means defining ink passages comprises a set of channels in the resin rod.

9. A ball-holder according to claim 8; wherein the set of channels extend lengthwise along the periphery of the resin rod.

10. A ball-holder according to claim 5; wherein the pair of expansions lie along an imaginary line which is perpendicular to an imaginary line connecting the pair of projections.

* * * * *